US006286436B1

(12) United States Patent
Sansalone

(10) Patent No.: US 6,286,436 B1
(45) Date of Patent: Sep. 11, 2001

(54) MOBILE CEMENT LAYING MACHINE

(76) Inventor: Giancarlo A. Sansalone, 71 Matson Drive, Bolton, Ontario (CA), L7E 5R8

( * ) Notice: Subject to any disclaimer, the term of this patent is extended or adjusted under 35 U.S.C. 154(b) by 0 days.

(21) Appl. No.: 09/405,704

(22) Filed: Sep. 24, 1999

(51) Int. Cl.[7] ..... B61D 7/02

(52) U.S. Cl. ..... 105/247; 105/280; 105/284; 105/286; 105/299; 105/304; 404/80; 404/84.2; 404/101; 52/749.13; 52/749.1

(58) Field of Search ..... 105/247, 280, 105/284, 286, 299, 304; 172/40, 91, 97; 111/925; 52/749.13, 749.1; 404/80, 81, 84.1, 84.2, 101, 103, 105, 106, 108, 114

(56) References Cited

U.S. PATENT DOCUMENTS

| | | | | |
|---|---|---|---|---|
| D. 344,736 | | 3/1994 | Allen et al. . | |
| 1,613,051 | * | 1/1927 | Napier | 404/114 |
| 2,201,534 | | 5/1940 | Hallenbeck . | |
| 3,008,432 | * | 11/1961 | Kemper | 105/180 |
| 3,316,821 | * | 5/1967 | Davin | 404/114 |
| 3,817,644 | * | 6/1974 | Matson | 404/114 |
| 3,969,056 | | 7/1976 | Larsen et al. . | |
| 4,127,351 | * | 11/1978 | Vural | 404/72 |
| 4,207,041 | | 6/1980 | Kampiziones . | |
| 4,217,065 | | 8/1980 | Stilwell . | |
| 4,280,800 | * | 7/1981 | Bunn | 425/62 |
| 4,710,054 | * | 12/1987 | Allen | 404/110 |
| 4,733,617 | * | 3/1988 | Boeniger | 105/29.2 |
| 4,747,726 | * | 5/1988 | Garner et al. | 404/123 |
| 5,103,690 | * | 4/1992 | Macpherson | 74/665 |
| 5,119,736 | * | 6/1992 | Chiodi | 105/158.2 |
| 5,533,829 | * | 7/1996 | Campbell | 404/81 |

* cited by examiner

*Primary Examiner*—S. Joseph Morano
*Assistant Examiner*—Frantz F. Jules

(57) ABSTRACT

A mobile cement laying machine for delivering concrete via tracks to areas which are difficult to access by truck. The mobile cement laying machine includes a carriage with a front end and a back end. A hopper is mounted to an upper side of the carriage toward the front end of the carriage. The hopper has an open top and a slot providing a lower opening into the hopper for dispensing cement from the hopper. A gate substantially closes the slot of the hopper. A pair of first rail wheels are coupled to the carriage towards the front end of the carriage. A pair of second rail wheels are coupled to the carriage towards the back end of the carriage.

15 Claims, 5 Drawing Sheets

MOBILE CEMENT LAYING MACHINE

BACKGROUND OF THE INVENTION

1. Field of the Invention

The present invention relates to cement dispensing machinery and more particularly pertains to a new mobile cement laying machine for delivering concrete via tracks to areas which are difficult to access by truck.

2. Description of the Prior Art

The use of cement dispensing machinery is known in the prior art. More specifically, cement dispensing machinery heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,969,056; U.S. Pat. No. 4,207,041; U.S. Pat. No. 4,217,065; U.S. Pat. No. 4,280,800; U.S. Pat. No. 2,201,534; and U.S. Pat. No. Des. 344,736.

While these devices fulfill their respective, particular objectives and requirements, the aforementioned patents do not disclose a new mobile cement laying machine. The inventive device includes a carriage with a front end and a back end. A hopper is mounted to an upper side of the carriage toward the front end of the carriage. The hopper has an open top, and a slot providing a lower opening into the hopper for dispensing cement from the hopper. A gate substantially closes the slot of the hopper. A pair of first rail wheels are coupled to the carriage towards the front end of the carriage. A pair of second rail wheels are coupled to the carriage towards the back end of the carriage.

In these respects, the mobile cement laying machine according to the present invention substantially departs from the conventional concepts and designs of the prior art, and in so doing provides an apparatus primarily developed for the purpose of delivering concrete via tracks to areas which are difficult to access by truck.

SUMMARY OF THE INVENTION

In view of the foregoing disadvantages inherent in the known types of cement dispensing machinery now present in the prior art, the present invention provides a new mobile cement laying machine construction wherein the same can be utilized for delivering concrete via tracks to areas which are difficult to access by truck.

The general purpose of the present invention, which will be described subsequently in greater detail, is to provide a new mobile cement laying machine apparatus and method which has many of the advantages of the cement dispensing machinery mentioned heretofore and many novel features that result in a new mobile cement laying machine which is not anticipated, rendered obvious, suggested, or even implied by any of the prior art cement dispensing machinery, either alone or in any combination thereof.

To attain this, the present invention generally comprises a carriage with a front end and a back end. A hopper is mounted to an upper side of the carriage toward the front end of the carriage. The hopper has an open top and a slot providing a lower opening into the hopper for dispensing cement from the hopper. A gate substantially closes the slot of the hopper. A pair of first rail wheels are coupled to the carriage towards the front end of the carriage. A pair of second rail wheels are coupled to the carriage towards the back end of the carriage.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mobile cement laying machine apparatus and method which has many of the advantages of the cement dispensing machinery mentioned heretofore and many novel features that result in a new mobile cement laying machine which is not anticipated, rendered obvious, suggested, or even implied by any of the prior art cement dispensing machinery, either alone or in any combination thereof.

It is another object of the present invention to provide a new mobile cement laying machine which may be easily and efficiently manufactured and marketed.

It is a further object of the present invention to provide a new mobile cement laying machine which is of a durable and reliable construction.

An even further object of the present invention is to provide a new mobile cement laying machine which is susceptible of a low cost of manufacture with regard to both materials and labor, and which accordingly is then susceptible of low prices of sale to the consuming public, thereby making such mobile cement laying machine economically available to the buying public.

Still yet another object of the present invention is to provide a new mobile cement laying machine which provides in the apparatuses and methods of the prior art some of the advantages thereof, while simultaneously overcoming some of the disadvantages normally associated therewith.

Still another object of the present invention is to provide a new mobile cement laying machine for delivering concrete via tracks to areas which are difficult to access by truck.

Yet another object of the present invention is to provide a new mobile cement laying machine which includes a carriage with a front end and a back end. A hopper is mounted to an upper side of the carriage toward the front end of the carriage. The hopper has an open top and a slot providing a lower opening into the hopper for dispensing cement from the hopper. A gate substantially closes the slot of the hopper. A pair of first rail wheels are coupled to the carriage towards the front end of the carriage. A pair of second rail wheels are coupled to the carriage towards the back end of the carriage.

Still yet another object of the present invention is to provide a new mobile cement laying machine that may be used during road construction to help avoid traffic disruption. Rails on which the invention travels are laid on the opposite side of the lane being constructed as the lane of traffic.

Even still another object of the present invention is to provide a new mobile cement laying machine that significantly reduces the amount of labor required to lay concrete in and around railroad tracks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
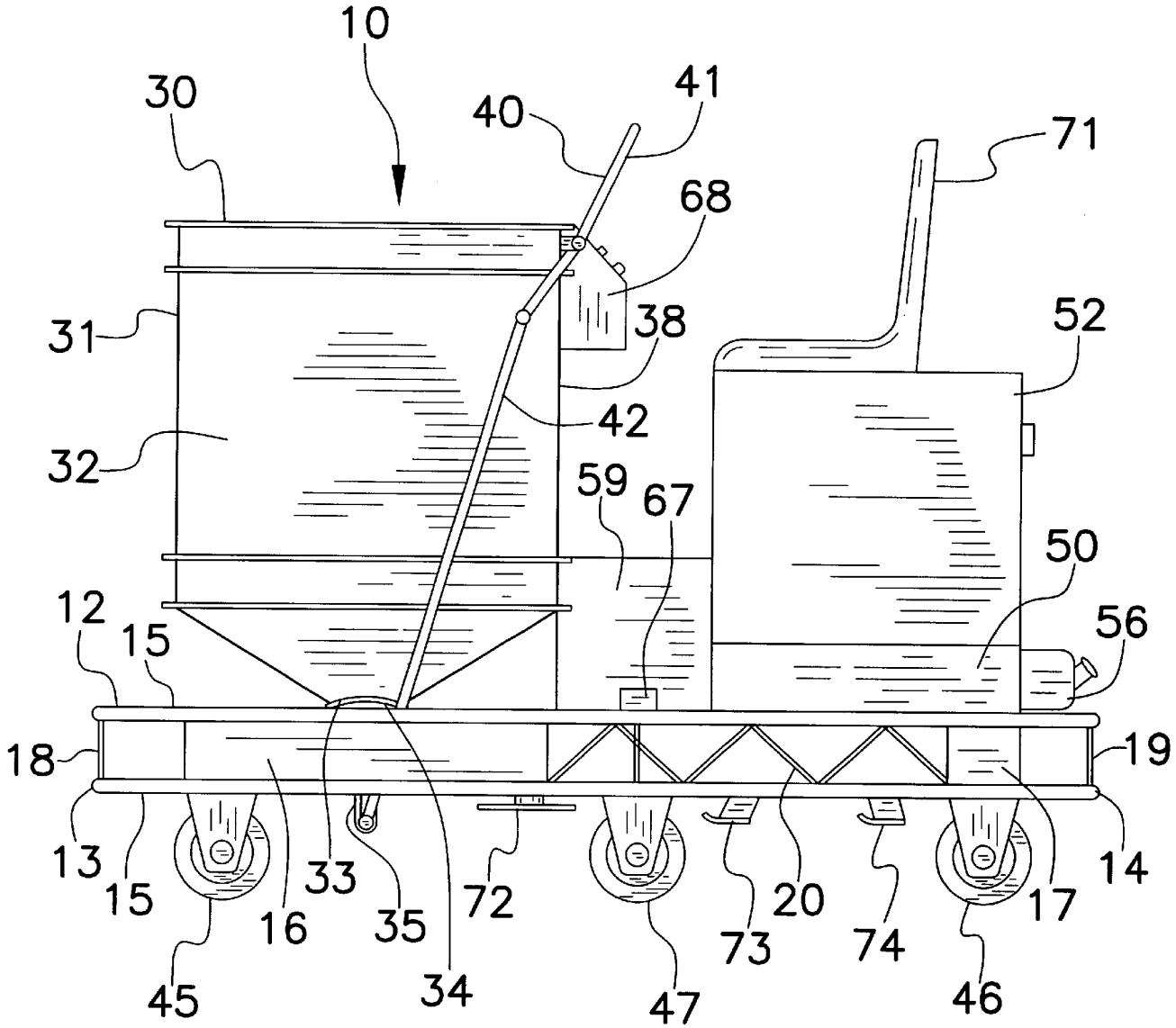
FIG. 1 is a schematic side view of a new mobile cement laying machine according to the present invention.

With reference now to the drawings, and in particular to FIGS. 1 through 5 thereof, a new mobile cement laying machine embodying the principles and concepts of the present invention and generally designated by the reference numeral 10 will be described.

As best illustrated in FIGS. 1 through 5, the mobile cement laying machine 10 generally comprises a carriage 12 with a front end 13 and a back end 14. A hopper 30 is mounted to an upper side of the carriage 12 toward the front end 13 of the carriage 12. The hopper 30 has an open top, an interior, and a slot 33 providing a lower opening into the interior for dispensing cement from the interior of the hopper 30. A gate 35 substantially closes the slot 33 of the hopper 30. A pair of first rail wheels 45 are coupled to the carriage 12 towards the front end 13 of the carriage 12. A pair of second rail wheels 46 are coupled to the carriage 12 towards the back end 14 of the carriage 12.

Preferably, the carriage 12 comprises a pair of vertically spaced apart frames 15 each forming a generally rectangular ring with rounded corners. A pair of forward panels 16 extend between the frames 15 towards the front end 13 of the carriage 12. A pair of rear panels 17 extend between the frames 15 towards the back end 14 of the carriage 12. A first set of angle members 18 extend between the frames 15 along the front end 13 of the carriage 12. A second set of angle members 19 extend between the frames 15 along the back end 14 of the carriage 12. Third and fourth sets of angle members 20, 21 extend between the frames 15 between a forward panel and an aligned rearward panel. The angle members alternate such that each of the angle members is positioned at about a 90 degree angle from an adjacent angle member. The spacing between the spaced apart frames 15 and alternating angle members permit easier washing of the underside of the machine 10.

Also preferably, the hopper 30 has front and back sides 31,38 and a pair of second sides 32 that extend between the front and back sides 31, 38 of the hopper 30. The open top and interior of the hopper 30 are defined by the first and sidewalls 32 of the hopper 30. The hopper 30 is adapted to receive a quantity of concrete in its interior. Ideally, the bottom portions of each of the front and back sides 31, 38 of the hopper 30 taper towards each other and form a slot 33 therebetween. Lower portions of each of the sidewalls 32 of the hopper 30 taper towards each other to form side edges 34 of the slot 33.

The gate 35 substantially closes the slot 33 of the hopper 30. Preferably, pivot points 36 of the gate 35 are pivotally coupled to the carriage 12.

Figure 2:
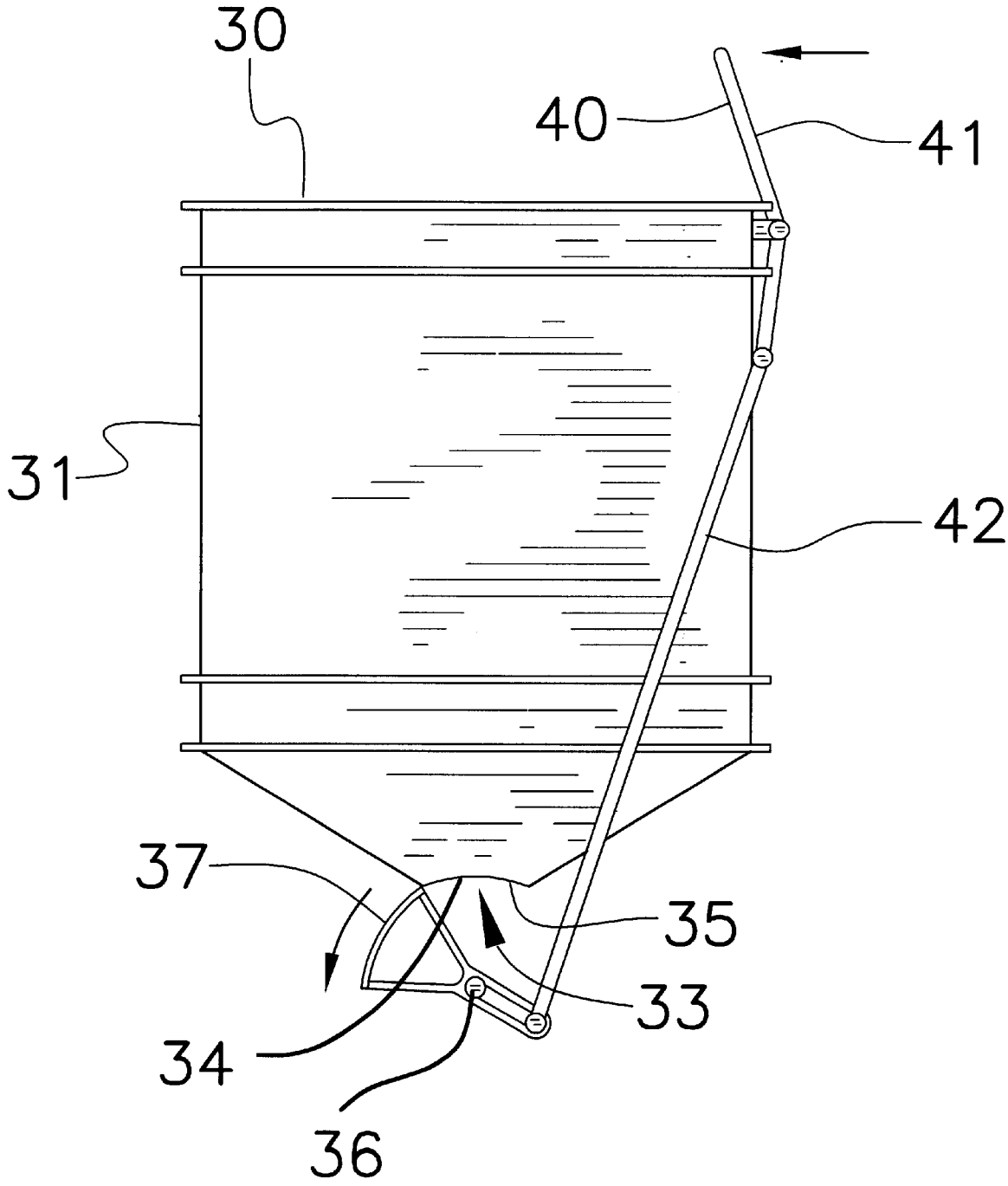
FIG. 2 is a schematic side view of the hopper bucket of the present invention.

Preferably, a handle 40 opens the gate 35. The handle 40 has a generally inverted U-shape and has a grasping portion 41 that is pivotally coupled to an upper end of the hopper 30 adjacent where a person would sit for easy access. A pair of rods 42 are pivotally coupled to free ends of the grasping portion 41. Each of the rods 42 is pivotally coupled to the gate 35. The grasping portion 41 of the handle 40 pivots in first and second directions. The gate 35 is opened, as shown in FIG. 2, when the grasping portion 41 pivots in the first direction. The gate 35 is closed, as shown in FIG. 1, when the grasping portion 41 pivots in the second direction.

Also preferably, the side edges 34 of the slot 33 of the hopper 30 are arcuate. A face 37 of the gate 35 is also arcuate and has about the same curvature as the side edges 34 of the slot 33. This shape gives more control over the amount of material passing through the slot 33 when only opening the slot 33 slightly.

Preferably, a pair of third rail wheels 47 are coupled to the carriage 12 between the first and second rail wheels 46. Each of the rail wheels comprises a disc 48 with a peripheral flange 49 extending from it. The rail wheels are adapted for rolling along a pair of spaced apart tracks such as railroad tracks.

Also preferably, a reservoir housing 50 is coupled to the upper side of the carriage 12 and positioned towards the back end 14 of the carriage 12. The reservoir housing 50 has a hydraulic tank 51 therein adapted for storing hydraulic fluid. A motor compartment 52 is coupled to the reservoir housing 50.

Preferably, a drive motor 53 for driving the machine 10 forward and backward is disposed in the motor compartment 52. The drive motor 53 may either comprise a combustion engine 54 or an electric motor 55. The motor 53 is operatively coupled to at least one of the second or third rail wheels. A fuel tank 56 extends from the reservoir housing 50. The motor 53 is in fluid communication with the fuel tank 56. A battery 57 is disposed in the motor 53 housing. The motor 53 is in communication with the battery 57.

Also preferably, a hydraulic pump 58 is coupled to the motor 53. A hydrostatic drive mechanism (not shown) is in fluid communication with the hydraulic pump 58 and the second or third rail wheels 47 for transferring power from the motor 53 to the third rail wheels 47. Hydrostatic drive mechanisms are known in the art, and therefore will not be discussed. The hydrostatic drive mechanism is in fluid communication with the hydraulic tank 51. A drive compartment 59 is positioned between the motor compartment 52 and the hopper 30. The hydrostatic drive mechanism is disposed in the drive compartment 59.

Figure 3:
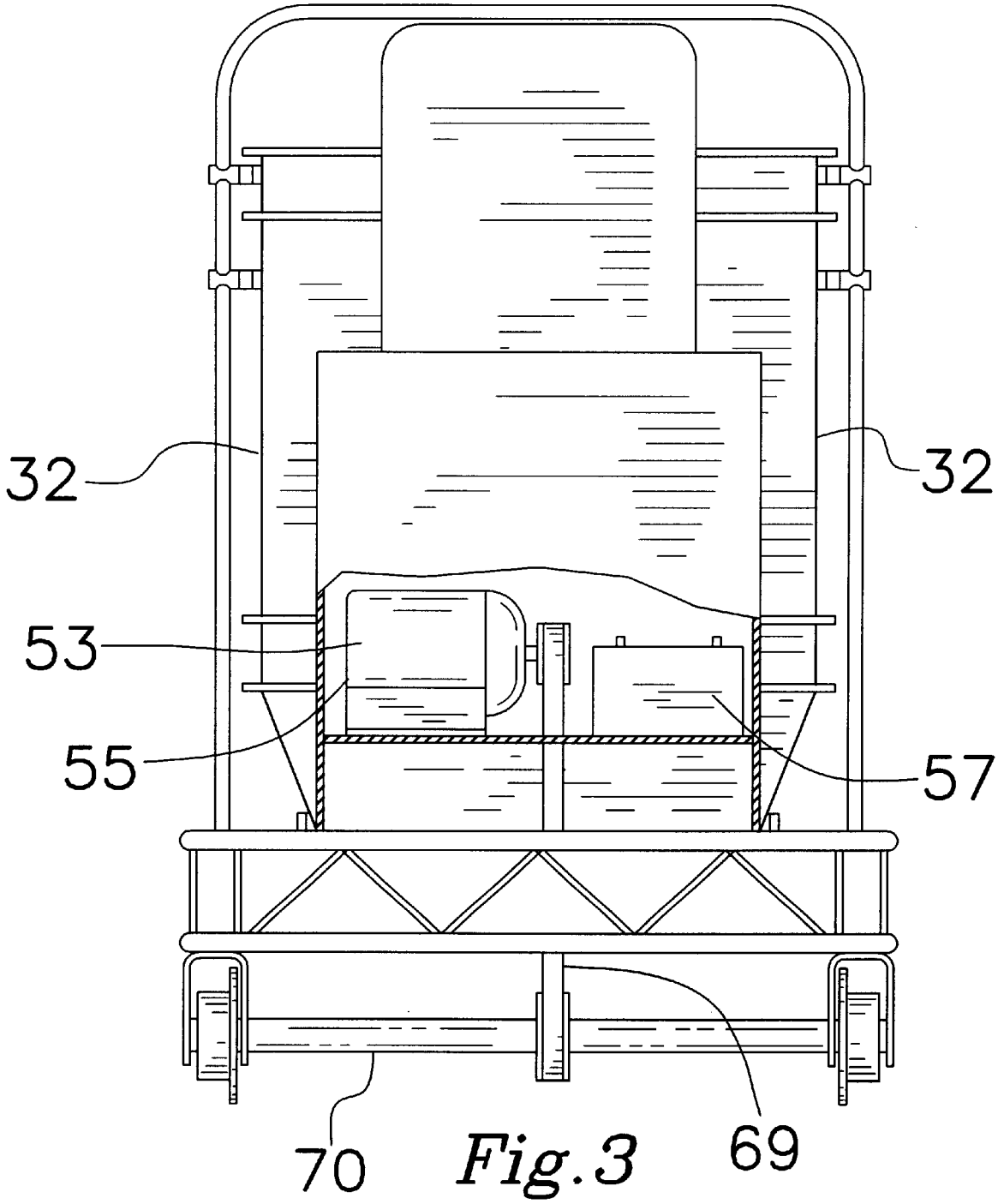
FIG. 3 is a schematic partial break away side view of the present invention.
Figure 4:
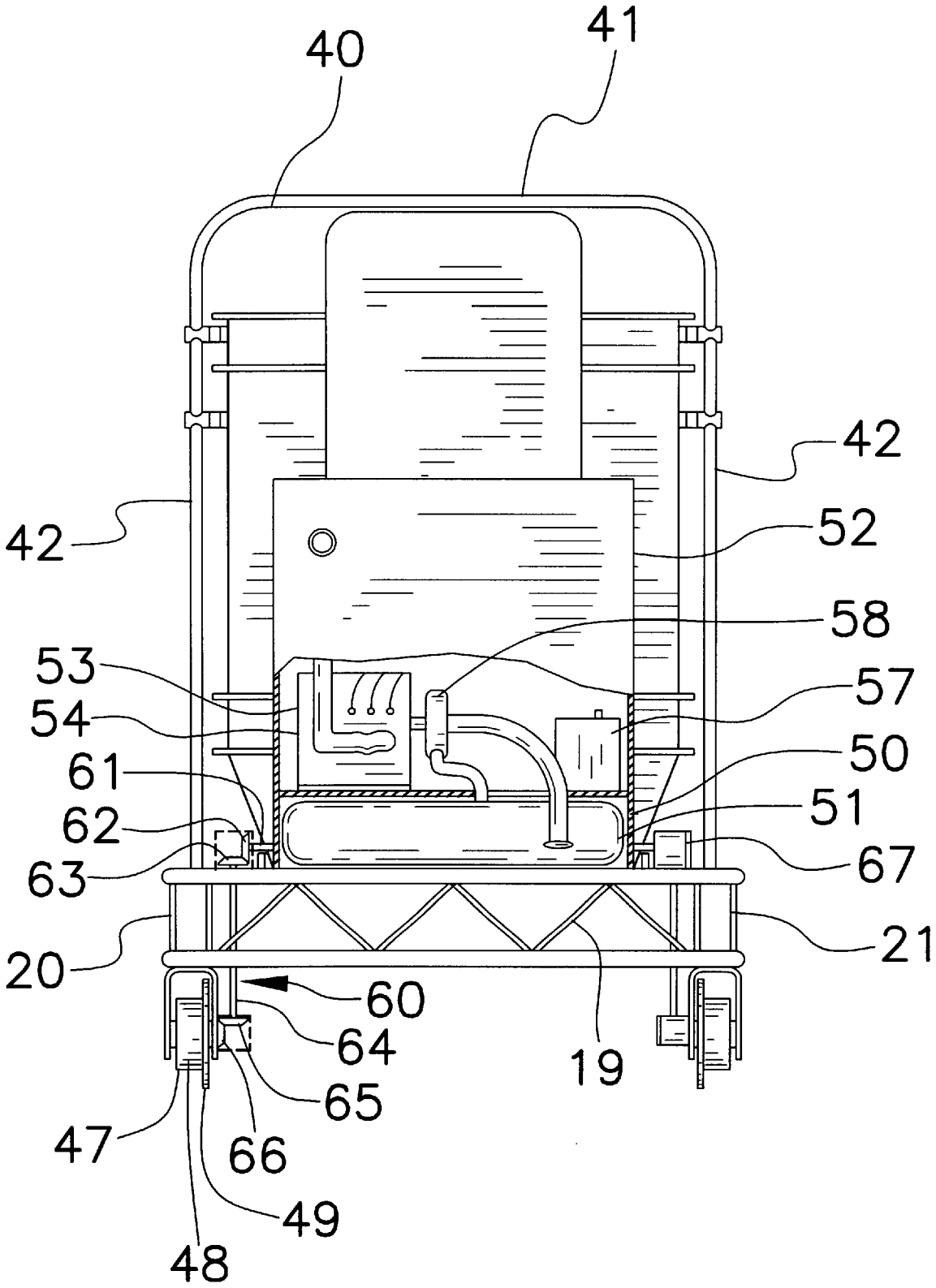
FIG. 4 is a schematic partial break away side view of the present invention.
Figure 5:
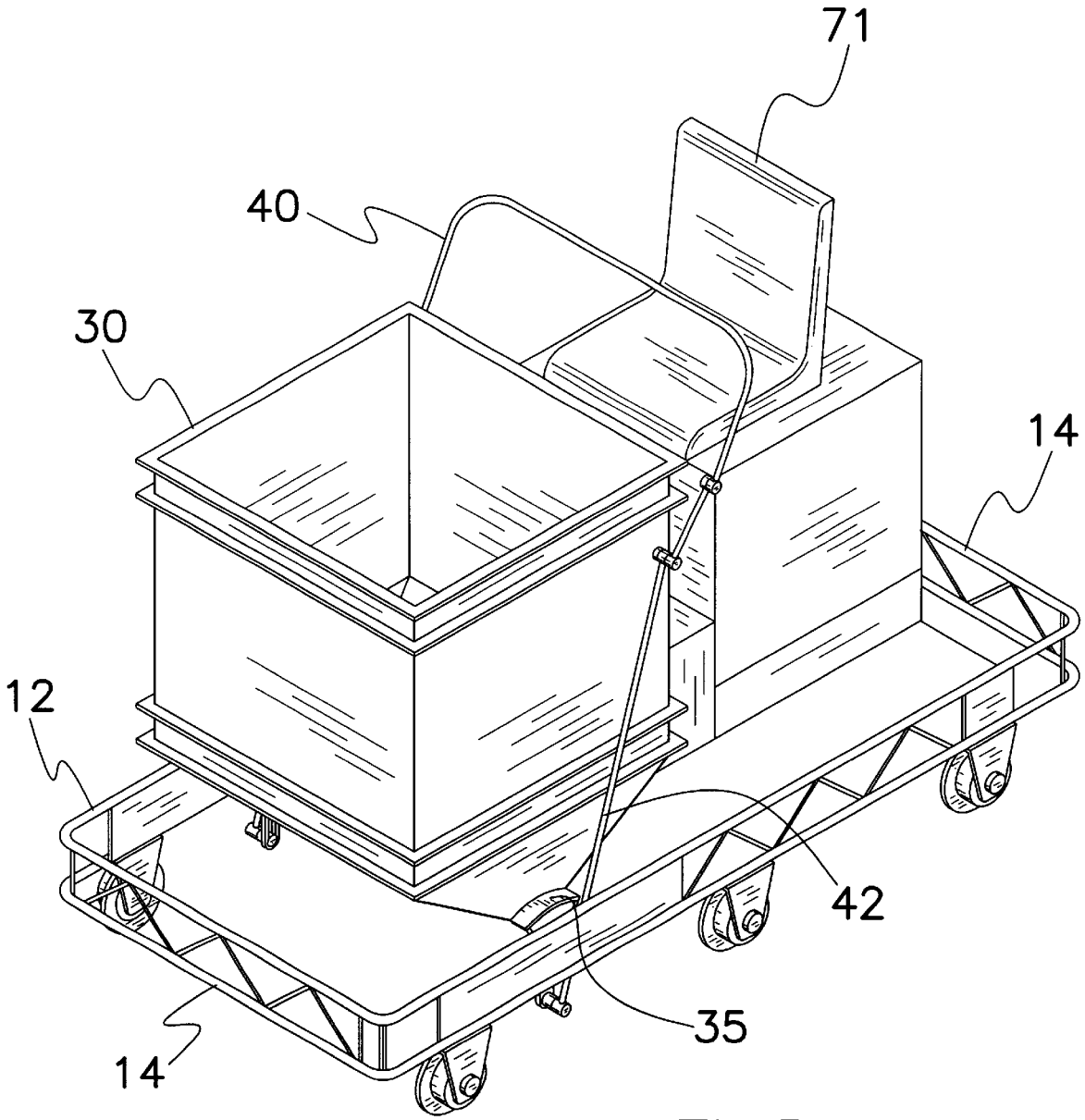
FIG. 5 is a schematic perspective view of the present invention.

Preferably, a pair of drive systems 60 extend between the hydrostatic drive mechanism and the second or third rail wheels 47 for transferring power from the hydrostatic drive mechanism to the second or third rail wheels 47. Each of the drive systems 60 comprises a first shaft 61 operatively coupled to the hydrostatic drive mechanism, a first bevel gear 62 coupled to the first shaft 61, a second bevel gear 63 engaging the first bevel gear 62, a second shaft 64 extending from the second bevel gear 63, a third bevel gear 65 coupled to the second shaft 64, and a fourth bevel gear 66 that is coupled to an associated rail wheel. The bevel gears are housed in a pair of gear housings 67. An alternate drive mechanism is shown in FIG. 3. This alternate drive mechanism comprises a drive belt 69 that extends between the motor 53 and a drive shaft 70 that extends between the third rail wheels 47.

A control panel 68 is coupled to the hopper 30 and is in communication with the hydrostatic drive mechanism and the motor 53. A seat 71 is coupled to the motor 53 housing.

Preferably, several attachments are detachably coupleable to the carriage 12. A vibrating pad 72 may extend downwardly from a lower side of the carriage 12 across the width of the carriage 12 and parallel the front end 13 of the carriage 12. Ideally, the vibrating pad 72 is positioned between the pair of third rail wheels 47 and the slot 33 of the hopper 30. A first screed 73 may extend downwardly from a lower side of the carriage 12 across the width of the carriage 12 and parallel the front end 13 of the carriage 12. Ideally, the first screed 73 is positioned between the pair of third rail wheels 47 and the back end 14 of the carriage 12. A second screed 74 may extend downwardly from a lower side of the carriage 12 across the width of the carriage 12 and parallel the front end 13 of the carriage 12. The second screed 74 is positioned between the first screed 73 and the back end 14 of the carriage 12.

Other optional equipment which may form part of the machine 10 include a conveyor system (not shown) to deliver concrete to an area other than below the hopper 30 or into a second hopper 30.

In use, the rail wheels of the machine 10 are placed on a pair of spaced apart tracks. Cement is placed in the interior of the hopper 30. The motor 53 drives the machine 10 forward or backward to a desired location. The handle 40 is pushed in the first direction to slowly open the gate 35 until the desired amount of concrete passes through the slot 33 from the interior of the hopper 30. The machine 10 may continue to move along the tracks. When the desired amount of concrete has been laid, the handle 40 is pushed in the second direction to close the gate 35, thereby closing the slot 33 of the hopper 30. As the machine 10 passes over the freshly laid concrete, the vibrating pad 72 vibrates it to help it settle and spread out in the form. The first and second screed 74s smooth off the top of the freshly laid concrete.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cement laying machine for delivering concrete via tracks, comprising:

a carriage having a front end and a back end;

a hopper being mounted to an upper side of said carriage toward said front end of said carriage, said hopper having an open top, an interior, and a slot providing a lower opening into said interior;

a gate for substantially closing said slot of said hopper;

a pair of first rail wheels being coupled to said carriage towards said front end of said carriage;

a pair of second rail wheels being coupled to said carriage towards said back end of said carriage; and said carriage comprising a pair of vertically spaced apart frames each forming a generally rectangular ring, a pair of forward panels extending between said frames towards said front end of said carriage, a pair of rear panels extending between said frames towards said back end of said carriage, a first set of angle members extending between said frames along said front end of said carriage, a second set of angle members extending between said frames along said back end of said carriage, and third and fourth sets of angle members extending between said frames and between one of said forward panels and an aligned rearward panel.

2. The cement laying machine of claim 1, wherein said hopper has front and back sides and a pair of sidewalls extending between said front and back sides of said hopper, said open top and said interior of said hopper being defined by said front and said back sides and said pair of sidewalls of said hopper, bottom portions of each of said front and back sides of said hopper tapering towards each other and forming said slot therebetween, lower portions of each of said sidewalls of said hopper tapering towards each other and forming side edges of said slot.

3. The cement laying machine of claim 2, wherein said side edges of said slot of said hopper are arcuate, a face of said gate being arcuate and slidably engaging said first and sidewalls of said hopper.

4. The cement laying machine of claim 1, further comprising a handle for opening said gate, said handle having a generally inverted U-shape, said handle having a grasping portion being pivotally coupled to an upper end of said hopper and a pair of rods being pivotally coupled to free ends of said grasping portion, each of said rods being pivotally coupled to said gate, said grasping portion of said handle pivoting in first and second directions, said gate opening said slot as said grasping portion pivots in said first direction, said gate closing said slot as said grasping portion pivots in said second direction.

5. The cement laying machine of claim 1, further comprising a drive motor operatively coupled to at least one of said pairs of first and second rail wheels.

6. The cement laying machine of claim 5, further comprising a hydrostatic drive mechanism being in communication with said drive motor and said rail wheel for transferring power from said motor to said rail wheel.

7. The cement laying machine of claim 6, further comprising a drive system extending between said hydrostatic drive mechanism and said rail wheel for transferring power from said hydrostatic drive mechanism to said rail wheel, said drive system comprising a first shaft operatively coupled to said hydrostatic drive mechanism, a first bevel gear coupled to said first shaft, a second bevel gear engaging said first bevel gear, a second shaft extending from said second bevel gear, a third bevel gear coupled to said second shaft, and a fourth bevel gear being coupled to an associated rail wheel.

8. The cement laying machine of claim 5, wherein said drive motor comprises an electric motor coupled to a battery, a drive belt extending between said electric motor and a drive shaft extending between a pair of said rail wheels.

9. The cement laying machine of claim 1, further comprising a vibrating pad extending downwardly from a lower side of said carriage, said vibrating pad being positioned between a pair of third rail wheels, said pair of third rail wheels being coupled to said carriage between said pairs of first and second rail wheels and said slot of said hopper.

10. The cement laying machine of claim 9, wherein said vibrating pad is detachable from said carriage.

11. The cement laying machine of claim 1, further comprising a first screed extending downwardly from a lower side of said carriage.

12. The cement laying machine of claim 11, wherein said first screed is detachable from said carriage.

13. The cement laying machine of claim 12, further comprising a second screed extending downwardly from said lower side of said carriage, said second screed being positioned between said first screed and said back end of said carriage.

14. The cement laying machine of claim 13, wherein said second screed is detachable from said carriage.

15. A cement laying machine for delivering concrete via tracks, comprising:

a carriage having a front end and a back end, said carriage comprising a pair of vertically spaced apart frames each forming a generally rectangular ring, a pair of forward panels extending between said frames towards said front end of said carriage, a pair of rear panels extending between said frames towards said back end of said carriage, a first set of angle members extending between said frames along said front end of said carriage, a second set of angle members extending between said frames along said back end of said carriage, and third and fourth sets of angle members extending between said frames between a forward panel and an aligned rearward panel, said angle members alternating such that each of said angle members is positioned at about a 90 degree angle from an adjacent angle member;

a hopper being mounted to an upper side of said carriage toward said front end of said carriage, said hopper having a pair of front and back sides and a pair of sidewalls extending between said front and back sides of said hopper and an open top, said hopper being adapted for receiving a quantity of concrete;

bottom portions of each of said front and back sides of said hopper tapering towards each other and forming a slot therebetween;

lower portions of each of said sidewalls of said hopper tapering towards each other and forming side edges of said slot;

a gate for substantially closing said slot of said hopper, pivot points of said gate being pivotally coupled to said carriage;

a handle for opening said gate, said handle having a generally inverted U-shape, said handle having a grasping portion being pivotally coupled to an upper end of said hopper and a pair of rods being pivotally coupled to free ends of said grasping portion, each of said rods being pivotally coupled to said gate;

said grasping portion of said handle pivoting in first and second directions, said gate opening said slot as said grasping portion pivots in said first direction, said gate closing said slot as said grasping portion pivots in said second direction;

wherein said side edges of said slot of said hopper are arcuate, a face of said gate being arcuate;

a pair of first rail wheels being coupled to said carriage towards said front end of said carriage;

a pair of second rail wheels being coupled to said carriage towards said back end of said carriage;

a pair of third rail wheels being coupled to said carriage between said first and second rail wheels;

each of said rail wheels comprising a disc with a peripheral flange extending therefrom, said rail wheels being adapted for rolling along a pair of spaced apart tracks;

a reservoir housing being coupled to said upper side of said carriage and positioned towards said back end of said carriage, said reservoir housing having a hydraulic tank therein adapted for storing hydraulic fluid;

a motor compartment being coupled to said reservoir housing;

a drive motor being disposed in said motor compartment, said motor being operatively coupled to said third rail wheels;

a fuel tank extending from said reservoir housing, said motor being in fluid communication with said fuel tank;

a battery being disposed in said motor housing, said motor being in communication with said battery;

a hydraulic pump being coupled to said motor;

a hydrostatic drive mechanism being in fluid communication with said hydraulic pump and said third rail wheels for transferring power from said motor to said third rail wheels, said hydrostatic drive mechanism being in fluid communication with said hydraulic tank;

a drive compartment being positioned between said motor compartment and said hopper, said hydrostatic drive mechanism being disposed in said drive compartment;

a pair of drive systems extending between said hydrostatic drive mechanism and said third rail wheels for transferring power from said hydrostatic drive mechanism to said third rail wheels, each of said drive systems comprising a first shaft operatively coupled to said hydrostatic drive mechanism, a first bevel gear coupled to said first shaft, a second bevel gear engaging said first bevel gear, a second shaft extending from said second bevel gear, a third bevel gear coupled to said second shaft, and a fourth bevel gear being coupled to an associated third rail wheel, said bevel gears being housed in a pair of gear housings;

a control panel being coupled to said hopper and in communication with said hydrostatic drive mechanism;

a seat being coupled to said motor housing;

a vibrating pad extending downwardly from a lower side of said carriage, said vibrating pad being positioned between said pair of third rail wheels and said slot of said hopper;

a first screed extending downwardly from the lower side of said carriage, said first screed being positioned between said pair of third rail wheels and said back end of said carriage; and a second screed extending downwardly from the lower side of said carriage, said second screed being positioned between said first screed and said back end of said carriage.

* * * * *